United States Patent [19]
Slocumb

[11] 4,402,409
[45] Sep. 6, 1983

[54] REMARKABLE SUPERIOR PLASTIC NETTING FOR USE IN PALLETIZED LOADS

[75] Inventor: Robert C. Slocumb, Circle Pines, Minn.

[73] Assignee: Conwed Corporation, St. Paul, Minn.

[21] Appl. No.: 320,766

[22] Filed: Nov. 12, 1981

[51] Int. Cl.[3] ..... B65D 19/00; B65D 75/02; B65D 71/06

[52] U.S. Cl. ..... 206/597; 53/461; 229/87 R

[58] Field of Search ..... 206/597, 386, 497; 229/87 R, 62, 53; 108/55.3; 53/461, 559

[56] References Cited

U.S. PATENT DOCUMENTS 4,206,846 6/1980 Connolly ..... 229/87 R
4,332,326 1/1982 Kelly et al. ..... 206/497

*Primary Examiner*—William T. Dixson, Jr.
*Attorney, Agent, or Firm*—Eyre, Mann, Lucas & Just

[57] ABSTRACT

A remarkably superior plastic netting for use in palletized loads is disclosed. The plastic netting is composed of linear low density polyethylene. The netting is molecularly oriented by a minimum factor of 4 in the longitudinal direction. The resulting netting is highly desirable for use in the wrapping of palletized loads since it is relatively inexpensive, lightweight, strong, and has a low degree of permanent stretch coupled with a relatively high degree of elastic stretch.

10 Claims, 1 Drawing Figure

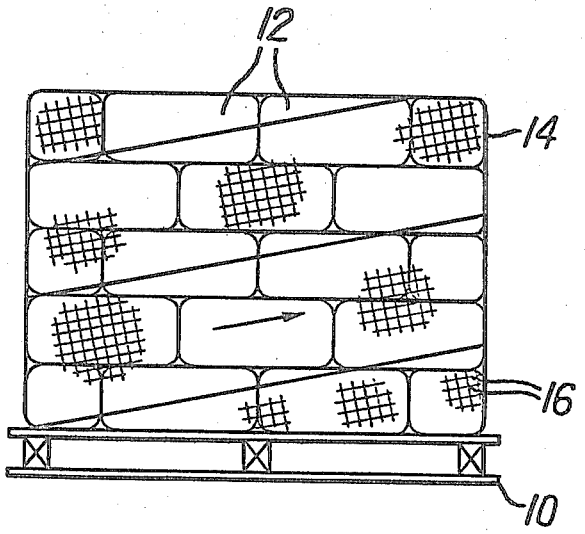
12
14
16
10

REMARKABLE SUPERIOR PLASTIC NETTING FOR USE IN PALLETIZED LOADS

The present invention relates to plastic netting and, in particular, to an improved plastic netting for use in the tension wrapping of palletized loads.

Tension wrapping of palletized loads in order to unitize the load is an old and well known process. It is taught, for example, in U.S. Pat. Nos. 3,495,375; 3,867,806; and 4,067,174. These patents teach the tension wrapping of palletized loads with films.

It has been found that in quite a few applications it is desirable to use a netting material to unitize a palletized load rather than using a film. The netting imparts "breathability" to the pallet and is of primary advantage in preventing condensation on the interior of the plastic film, which condensation has the distinct disadvantage of staining the packages on the pallet.

U.S. Pat. No. 3,945,493 discloses the use of a net material as a pallet wrap. The net material, in the form of a large bag, is placed over the entire pallet. The pallet with the net applied is then passed through a heat tunnel. The heat causes the net to heat shrink about the load, thereby unitizing it. The heat shrink method is quite effective. However, it has a number of substantial disadvantages. The first is a rather large capital investment for the heat shrink tunnel combined with the relatively high cost of operation. The alternative method of heat shrinking, a hand held gun-like apparatus, is also costly in both energy consumption and manpower. Furthermore, a net which will heat shrink will also heat stretch when passing through temperate zones, especially in the summer when the heat in the back of a trailer truck can become exceptionally high. Employment of a high heat shrink temperature can compensate for this but substantially increases energy costs and the high heat is also deleterious for many products. This is especially true for materials such as flour which tend to dust and to explode when subjected to high heat levels.

U.S. Pat. No. 4,136,501 eliminated some of the problems associated with heat shrinking but also caused new ones. In accordance with the teaching of this patent, a net which has a high degree of permanent stretch and elastic stretch is stretched as it is wrapped about the load. The stretched product retains a good deal of elastic stretch but also has a high degree of permanent stretch remaining. While there is no need for a heat tunnel, there are substantial problems with this method. One of these is that the rate and degree of stretching must be carefully controlled as the netting is applied to the load. This is quite difficult to accomplish. In addition, any discontinuity in the wrapping operation requires that it be started anew in order to ensure uniform stretching. Furthermore, since the net as it is stretch applied is not stretched anywhere near its permanent stretch limit, it has been found that it is capable of substantial further permanent stretch when subjected to normal palletized load stresses. It has been found that this can cause complete loss of unitization and is highly deleterious. This problem is particularly acute if the pallet is wrapped at ambient temperatures in a northern clime and is then shipped to a southern clime. The usual rise in temperature between the two contributes substantially to loosening of the load.

U.S. Pat. No. 4,208,457 discloses a substantial improvement over the stretch netting of U.S. Pat. No. 4,136,501. In accordance with the '457 patent teaching, the strands of the net are molecularly oriented before the net is applied to the load. The molecular orientation is carried out to a sufficient degree so that the net will not undergo further stretch, wither permanent or elastic, by more than 15% under normal palletized load stresses even at the highest temperatures normally encountered by palletized loads. The use of this particular netting is of great advantage over those previously available since the net does not require a heat tunnel or controlled stretching to apply and has substantially better holding power of the load than the heat shrunk or stretched net. Furthermore, because the net is molecularly oriented, it is substantially lighter and less expensive on an area/area basis.

While the net of the '457 patent is considered very excellent for many load unitizing applications, it has been found that it has disadvantage in some applications exactly because of its advantageous property that it does not give to any appreciable degree.

The applicants have discovered that it would be highly desirable to have a netting material, especially for use in palletized loads, which has a relatively low degree of permanent stretch but a relatively high degree of elastic stretch. The applicants have also discovered that such a net is attainable by using linear low density polyethylene (LLDPE) as the netting material and molecularly orienting the longitudinal strands of the net by at least about a factor of 4. The resulting net has a low degree of permanent stretch in the longitudinal direction coupled with a relatively high degree of elastic stretch.

The terms "permanent stretch" and "elastic stretch" as used herein have specific meanings. The term permanent stretch means non-recoverable stretch deformation e.g. when the net is put under a predetermined stress and strains to double its length and, when the stress is released, remains at that length, all of the additional length is permanent stretch. The term elastic stretch means recoverable stretch deformation, e.g. if the net in the previous sentence returned to its original length when the stress was released, the net would have 100% elastic recovery. There can, of course, be both permanent and elastic stretch caused by the same stress. For example, if the net referred to in this paragraph returned to 25% greater than its original length when the stress was released, it would have undergone 25% permanent stretch but would have an elastic stretch of 75% elastic recovery.

The plastic netting of the present invention is a sheet of netting with at least one set of substantially parallel strands extending in the longitudinal direction of the sheet and being called the longitudinal strands. The longitudinal strands are interconnected by at least one other set of strands which transverses them at an angle and is called the transverse set of strands. There may be more than one transverse set of strands but it is preferable that there be a single longitudinal set of strands and a single transverse set of strands, with the two crossing at substantially right angles.

The plastic netting to be used in accordance with the present invention is preferably formed by an extrusion process such as those disclosed in U.S. Pat. Nos. 3,252,181; 3,384,692; 3,700,521; 3,791,784 and the like which make so-called "square mesh" nets. Alternatively, the net may be made according to a "diamond mesh" process such as disclosed in U.S. Pat. No. 2,919,467 and then helically cut as taught, for example, in U.S. Pat. No. 3,674,898 to convert it to a "square mesh" net. All of these nets are well-known in the art. They are characterized by a plurality of sets of strands, the strands of at least one of the sets of strands being essentially parallel and being in the longitudinal direction. A typical net with two sets of strands at right angles and with the strands of each set being parallel is shown in U.S. Pat. No. 3,252,181, see especially FIGS. 1 and 12. As mentioned, a similar net can also be made according to U.S. Pat. No. 3,674,898, see FIG. 3. This net may have three sets of strands if desired, see British Pat. No. 1,290,437 and in particular FIGS. 1 and 2 thereof. Furthermore, the net can be a first set of parallel strands connected together by a helical strand, see, for example, U.S. Pat. No. 4,136,501. In this instance the single helical strand becomes one of the plurality of sets of strands when the tube is cut to form a flat sheet. It will be appreciated that the set of strands holding the parallel longitudinal strands in position need not be perpendicular to the longitudinal strands nor need they even by parallel to each other. It is only necessary that they maintain the longitudinal strands in spaced relationship and substantially parallel to each other and to the edge of the sheet.

No matter how the net is formed, after formation the longitudinal strands are molecularly oriented by a factor of at least 4. It is preferred that the orientation factor be at least 5. It has been found that orientation factors above about 6 are not generally practical. All sets of strands may be oriented if desired. However in accordance with the present invention it is only necessary that the longitudinal set of substantially parallel strands be oriented.

Methods of orienting plastic net material are well known in the art. Where only the single longitudinal set of strands is desired to be oriented, this can suitably be accomplished by so-called rope form orientation by applying racking tension, see U.S. Pat. No. 2,919,467. This rope form orientation can also be advantageously used with nets such as made by the process disclosed in U.S. Pat. No. 4,136,501.

With the so-called "square mesh" nets, such as those made according to U.S. Pat. No. 3,384,692 it is preferable that biaxial orientation be carried out so that both sets (all three sets in British Pat. No. 1,290,437) are oriented. This can suitably be accomplished with the process set forth in U.S. Pat. No. 4,152,479. The biaxial orientation is not limited to the square mesh nets and can also be used with nets such as those taught in U.S. Pat. No. 4,136,501 or those made according to U.S. Pat. No. 3,674,898.

In the preferred embodiment of the present invention, both the longitudinal strands and the transverse strands are molecularly oriented. The longitudinal strands are molecularly oriented by a factor of about 4 to 6 and the transverse direction strands are molecularly oriented by a factor of about $2\frac{1}{2}$ to 4.

The net, as extruded, suitably has from about 10 to about 30 strands per 10 inches extending in the longitudinal direction (i.e. the longitudinal strands), preferably from about 15 to about 20. For the strands extending in the transverse direction (i.e. the transverse strands) there may suitably be from about 3 to about 15 per 10 inches, preferably from about 5 to about 10. After molecular orientation, there are suitably about 2.5–12 strands per 10 inches extending in the longitudinal direction and preferably from about 3.75 to 8. For the strands extending in transverse direction after molecular orientation, there are suitably about 0.5–3.75 strands per 10 inches and there are preferably about 0.8–2.5 strands per 10 inches.

The exact dimensions of the net strands are not critical. However, it is preferred that the cross sectional area of the longitudinal strands be between about 1.0 and $1.5\times10^{-3}$ square inches and the most preferable cross sectional area is about $1.25\times10^{-3}$ square inches. The transverse strands preferably have a cross sectional area between about 0.25 and $0.5\times10^{-3}$ square inches and the most cross sectional area is about $0.35\times10^{-3}$ square inches. The extruded net can suitably weigh from about 10 to about 20 pounds per thousand square feet, preferably from about 10 to about 15 pounds per thousand square feet. After molecular orientation, it is preferred that the net weigh about 0.5–2 pounds per thousand square feet and it is most preferable that it have a weight between about 0.5 and about 1 pound per thousand square feet.

The resin used in the making of the netting of the present invention is preferably linear low density polyethylene (LLDPE). This is a commercially available product and is available, for example, from Dow under the trademark Dowlex and from Exxon under the trademark LPX-1. It has been found the LLDPE when molecularly oriented as previously discussed has very little permanent stretch but still has quite a high degree of elastic stretch.

The longitudinal strands of the net should be predominantly composed of LLDPE. Other resins may be copolymerized and/or blended with the LLDPE e.g. low density polyethylene, polypropylene and other compatible resins provided they do not adversely affect the desirable properties of low permanent stretch and relatively high elastic stretch. However, it is preferred that the net be at least 90% LLDPE, most preferably above 98% LLDPE and best results are obtained with 100% LLDPE. It is also preferred that all sets of strands be composed of LLDPE. However, the transverse strands may be composed of a non-stretchable polymer, e.g. oriented polypropylene, or of a highly stretchable polymer, e.g. polybutylene, if desired.

No matter what the exact resin of which the net is composed, it is necessary that the longitudinal strands have a low permanent stretch capability and a high elastic stretch. More particularly, the molecularly oriented longitudinal strands should have a maximum stretch to break of 70–80% when stretched at a rate of one thousand percent per minute.

With respect to elastic stretch, this is determined for the applied product. When the net is tension wrapped about the pallet, it must be stretched by a minimum of about 5% but should not be stretched by more than about 20%; it is preferably applied at a stretch rate of about 10–15%. In normal tension wrapping of palletized loads, there is applied a tension of about 20–30 pounds per 20 inches and this will generally achieve the desired degree of stretch. When stretched to this degree, at least the longitudinal strands of the net should have two-hour elastic recovery of at least about 50% and should have an elastic recovery after two weeks of at least about 35%. By this it is meant that if the net is relaxed after two hours it will recover at least 50% of the length to which it has been stretched and, if it is kept under tension for a period of two weeks and then relaxed, it will recover at least 35% of the length to which it has been stretched.

These and other aspects of the present invention are illustrated by the following examples.

EXAMPLE 1

A net was made in accordance with the present invention from LLDPE resin. The net was extruded according to the teaching in U.S. Pat. No. 3,384,692 and, as extruded, had approximately 17 strands per 10 inches extending in the longitudinal direction and approximately 8 strands per 10 inches extending in the transverse direction. The extruded net weighed about 14 pounds per thousand square feet.

The extruded net was biaxially molecularly oriented according to the teaching of U.S. Pat. No. 4,152,479. This molecular orientation was carried out at a temperature of about 120° F. The degree of orientation of the longitudinal direction was by a factor of 5.75 while in the transverse direction it was by a factor of 3.5. The molecularly oriented net had about 4.9 strands per 10 inches extending in the longitudinal direction and about 1.4 strands per 10 inches extending in the transverse direction. The molecularly oriented product weighed about 0.7 pounds per thousand square feet.

The net was then tested as a pallet wrap material. It was first subjected to normal tension wrap stresses of about 25 pounds per 20 inches to simulate application about a pallet. It was then subjected to stresses of about 45 pounds per 20 inches. This stress simulates the typical maximum stress to which many palletized loads are subjected in transit. When subjected to this force, the net of the present invention stretched further by less than 5% of its original length. At this stretch, it was found to have 60% two hour elastic recovery when the tension was released. When the net was subjected to this same force and the force was applied continuously for two weeks, the net was still found to have in excess of 50% elastic recovery.

When tested on an actual palletized load subjected to pre-set stress conditions, there was no noticeable looseness or shifting of the load at the completion of the test.

EXAMPLE 2

For comparison, a similar test was carried out with net made according to the teaching of U.S. Pat. No. 4,136,501. The '501 patent is assigned to Bemis Co., Inc., and the net used for the comparative test is available from Bemis under the trademark Stretchnet. The product tested weighed approximately 4.5 pounds per thousand square feet, i.e. more than six times as heavy as the net of Example 1.

This net was also applied under tension of 25 pounds per 20 inches and stretched about 55% as it was being applied. When this net was subjected to the 45 pound per 20 inch stress, it was found to stretch more than 180% above its original length, i.e. almost double its applied length. Its two hour elastic recovery was less than 30% and, when subjected to the two week test under the 45 pound per 20 inch force, the elastic recovery was less than 20%.

When this net was tested about a palletized load in the same manner as the test of Example 1, it was found that the load shifted considerably and also loosened to a deleterious extent. This looseness and shifting happened early on in the test procedure.

EXAMPLE 3

For comparison, still another test was carried out with a product following the teaching of U.S. Pat. No. 4,208,457. The '457 patent is assigned to Conwed Corporation and the net used for the comparative test is available from Conwed under the trademark Tensionet II. The product tested weighed about 1.5 pounds per thousand square feet, i.e. more than double the weight of the net according to the present invention as set forth in Example 1.

As with the other tests, this net was applied under a tension of about 25 pounds per 20 inches. When this net was subjected to the 45 pound per 20 inch force, there was no stretching whatsoever, even after two weeks. Since there was no stretch there could be no elastic recovery.

When this net was subjected to the same palletized load test as set forth in Example 1, it was found that the net did not conform well to the load because it lacked any elastic stretch. As a result of this, the load became loose with shifting under the test conditions. While this net performed substantially better than the net of Example 2, it did not perform nearly so well as the net of Example 1.

Plastic nettings according to the present invention can be used as pallet wraps on a wide variety of palletized loads by tension wrapping the plastic netting about the load on the pallet. This is accomplished with equipment well known in the art as discussed hereinbefore. It has been found that the nets according to the present invention are markedly superior to nets available in the prior art for pallet load wrapping, especially when high temperatures and/or rough handling is encountered.

The term palletized load as used herein is used generically to means a plurality of objects unitized with a pallet wrap. It includes, for example, a pallet or slip sheet (hereinafter collectively referred to as a pallet device) with a plurality of containers thereon, e.g. bags as shown in FIG. 1 of U.S. Pat. No. 3,945,493. As will be appreciated and as is well known in the art, the pallet wrap unitizes the load, i.e., makes it like a single unitary entity as shown in FIG. 2 of U.S. Pat. No. 3,945,493. In accordance with the present invention, the term palletized load also includes any other load which it unitized. For example, a stack of pallets can be unitized with a pallet wrap and would then be a palletized load. Similarly the term palletized load includes a stack of plywood, plaster board or the like with a pallet wrap unitizing it whether or not there is actually a pallet device at the bottom thereof. Notwithstanding, the primary advantage of the present invention is with a palletized load comprising a pallet device and a plurality of containers thereon, especially bags such as are used with cement, food products, plastic pellets and other granular or powdered materials.

The FIGURE shows a typical palletized load according to the present invention with bagged products such as those just mentioned.

In the FIGURE there is shown a pallet 10 having a plurality of containers 12 thereon. Wrapped about the pallet and containers to form a palletized load is a net 14 made in accordance with the present invention. The net is composed of linear low density polyethylene and the set of strands 16 extending in the longitudinal direction (arrow) is molecularly oriented.

There are a number of other important advantages in using the net of the present invention, not the least of which is cost. Because linear low density polyethylene is less expensive than the polypropylene and polybutylene used in known commercial products, this results in an immediate cost saving. This cost saving is substantially enhanced by the fact that the net can be made so lightweight and still perform excellently.

A further advantage of nets according to the present invention is very low temperature stability. It has been found that the nets of the present invention can be applied at much lower ambient temperatures than the commercially available nets while still retaining excellent properties.

It will be understood that the claims are intended to cover all changes and modifications of the preferred embodiments of the invention herein chosen for the purpose of illustration, which do not constitute departures from the spirit and scope of the invention. It will also be understood that the pertinent portion of all patents mentioned are incorporated herein by reference.

What is claimed is:

1. In a palletized load utilizing a net material as the pallet wrap, the improvement comprising said plastic net being comprised of a set of longitudinal strands running substantially parallel to the length of the net and at least a second set of strands transverse thereto, said longitudinal strands being predominantly composed of linear low density polyethylene and said longitudinal strands being molecularly oriented by a factor of at least about 4 before being applied to said palletized load, said plastic net when it is applied to said load having a low degree of permanent stretch and a high degree of elastic recovery.

2. The palletized load of claim 1 wherein there are two sets of strands, each of which is predominantly composed of linear low density polyethylene.

3. The palletized load of claim 2 wherein the second set of strands is molecularly oriented by a factor of at least about 2½.

4. The palletized load of claim 2 wherein at least 98% of the resin used to form said net is linear low density polyethylene.

5. The palletized load of claim 2 wherein said plastic netting material has between about 2.5 and 12 strands per 10 inches extending in the longitudinal direction and between about 0.5 and 3.75 strands per 10 inches extending in the transverse direction and weighs between about 0.5 and 2.0 pounds per thousand square feet.

6. The palletized load of claim 2 wherein said plastic netting material has between about 3.75 and 8 strands per 10 inches extending in the longitudinal direction and between 0.8 and 2.5 strands per 10 inches extending in the transverse direction and weighs between about 0.5 and 1.0 pounds per thousand square feet.

7. In the process of tension wrapping palletized loads with a plastic net, the improvement comprising said plastic net being predominantly composed of linear low density polyethylene, said plastic net comprising a plurality of sets of spaced strands, the strands of at least one set being substantially parallel and being in the longitudinal direction of the net, said one set of strands being molecularly oriented by a factor of at least about 4 before it is applied to said palletized load, said net, when applied to said palletized load, being characterized by low permanent stretch and high elastic stretch.

8. A sheet of plastic net comprising two sets of spaced strands, one set of strands being substantially parallel to the longitudinal direction of the said sheet and the other set of strands being transverse thereto, said strands being composed of linear low density polyethylene, said one set of strands being molecularly oriented by a factor between about 4 and 6 and the other set of strands being molecularly oriented by a factor between about 2.5 and 4, said molecularly oriented net having between about 2.5 and 12 strands per 10 inches extending in the longitudinal direction and between about 0.5 and 3.75 strands per 10 inches extending in the transverse direction, said net weighing between about 0.5 and 2.0 pounds per thousand square feet.

9. A unitized palletized load comprising a pallet device with a plurality of objects thereon, said palletized load being unitized by a sheet of net wrapped thereabout, said net comprising two sets of spaced strands, one said set of strands being substantially parallel to the longitudinal direction of the said sheet and the other said set of strands being transverse thereto, said one set of strands having a maximum stretch to break of no more than about 80% when stretched at a rate of 1000% per minute, said one set of strands having been stretched by between about 5% and about 20% as applied, said one set of strands having a two-hour elastic recovery of at least about 50% and a two week elastic recovery of at least about 35%.

10. In the unitized palletized load of claim 9, said one set of strands having been stretched by between about 10% and 15% as applied.

* * * * *

UNITED STATES PATENT AND TRADEMARK OFFICE

CERTIFICATE OF CORRECTION

PATENT NO. : 4,402,409

DATED : September 6, 1983

INVENTOR(S) : Robert Slocumb

It is certified that error appears in the above-identified patent and that said Letters Patent are hereby corrected as shown below:

Change the Title to read:

REMARKABLY SUPERIOR PLASTIC NETTING FOR USE IN PALLETIZED LOADS

Signed and Sealed this

*Twenty-second* Day of *November 1983*

[SEAL]

*Attest:*

GERALD J. MOSSINGHOFF

*Attesting Officer*

*Commissioner of Patents and Trademarks*